US006932654B2

(12) United States Patent
Washino

(10) Patent No.: US 6,932,654 B2
(45) Date of Patent: Aug. 23, 2005

(54) CONNECTOR

(75) Inventor: Kiyoshi Washino, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/898,975

(22) Filed: Jul. 27, 2004

(65) Prior Publication Data

US 2005/0026505 A1 Feb. 3, 2005

(30) Foreign Application Priority Data

Jul. 31, 2003 (JP) ..... 2003-204973

(51) Int. Cl.[7] ..... H01R 24/00

(52) U.S. Cl. ..... 439/630; 439/159; 439/60; 439/924.1; 439/218

(58) Field of Search ..... 439/630, 67, 59–62, 439/74, 924.1, 157–159, 945–946, 602, 64, 631, 377, 325, 166, 331, 106, 372, 326, 217–218; 361/737, 753, 741, 802, 728, 735

(56) References Cited

U.S. PATENT DOCUMENTS

| | | | | | |
|---|---|---|---|---|---|
| 5,716,221 | A | * | 2/1998 | Kantner | 439/64 |
| 6,010,066 | A | * | 1/2000 | Itou et al. | 235/379 |
| 6,386,920 | B1 | * | 5/2002 | Sun | 439/630 |
| 6,402,529 | B2 | * | 6/2002 | Saito et al. | 439/74 |
| 6,468,101 | B2 | * | 10/2002 | Suzuki | 439/326 |
| 6,641,413 | B2 | * | 11/2003 | Kuroda | 439/159 |
| 6,699,053 | B2 | * | 3/2004 | Kuroda | 439/218 |
| 6,700,788 | B2 | * | 3/2004 | Matsushita et al. | 361/737 |
| 6,773,308 | B2 | * | 8/2004 | Lwee | 439/630 |

FOREIGN PATENT DOCUMENTS

| | | | |
|---|---|---|---|
| JP | 05-189624 | A | 7/1993 |
| JP | 05-290565 | A | 11/1993 |
| JP | 07-028960 | A | 1/1995 |
| JP | 10-011548 | A | 1/1998 |
| JP | 10-011549 | A | 1/1998 |
| JP | 10-124627 | A | 5/1998 |
| JP | 10-240887 | A | 9/1998 |
| JP | 11-085915 | A | 3/1999 |
| JP | 3079263 | U | 5/2001 |
| JP | 2001-184462 | A | 7/2001 |
| JP | 2003-045563 | A | 2/2003 |
| JP | 2003-045574 | A | 2/2003 |
| JP | 2003-045575 | A | 2/2003 |

* cited by examiner

*Primary Examiner*—Truc T. Nguyen
*Assistant Examiner*—Edwin A. Leon
(74) *Attorney, Agent, or Firm*—Rader, Fishman & Grauer PLLC

(57) ABSTRACT

The present invention relates to, for example, a connector into which two kinds of memory cards with different thicknesses are insertable selectively. The connector includes: a housing which has a card insertion port; plural first contacts provided inside the housing; and plural second contacts provided between the first contacts and the card insertion port. The second contacts extend toward the first contacts and include: first contact portions provided at distal ends of the second contacts; and second contact portions provided further on proximal end sides of the second contacts than the first contacts. According to the invention, when the thick memory cards is inserted, the second contact portions come into abutment against the thick memory card, and when the thin memory cards is inserted, the first contact portions come into abutment against the thin memory card. Thus, durability of the connector can be improved.

4 Claims, 5 Drawing Sheets

CONNECTOR

CROSS-REFERENCE TO RELATED APPLICATIONS

This application is based upon and claims the benefit of priority from the prior Japanese Patent Application No. 2003-204973 filed on Jul. 31st in 2003, the entire contents of which is incorporated herein by reference.

FIELD OF THE INVENTION

The present invention relates to a connector for memory card which is electrically connected with a memory card such as a secure digital (SD) card standardized by the SD Card Association (SDA) or a high-speed multimedia card (MMC) standardized by the Multimedia Card Association (MMCA) as the memory card is inserted into the connector.

BACKGROUND OF THE INVENTION

Conventionally, there is known a memory card which is a card type storage.

Since a flash memory is adopted as a storage medium, this memory card is small in size and consumes almost no electric power for reading-out and writing of data. In addition, unlike disk type storages such as a flexible disk (FD) and a magneto-optical disk (MO), the memory card does not require a drive unit.

Therefore, the memory card is widely used as a storage medium for portable devices such as a digital camera, a cellular phone with a camera, a personal digital assistant (PDA), a notebook personal computer, and a portable music player.

Incidentally, the memory card is smaller in storage capacity and higher in price compared with the disk type storages such as a flexible disk (FD) and a magneto-optical disk (MO).

However, the storage capacity of the memory card has been increased to about 128 MB at the maximum with the advance of technology in recent years. In addition, in accordance with the spread of portable devices using the memory card, the memory card has been produced in large quantities. As a result, a price for the memory card has fallen.

The above-mentioned memory card is connected to a connector mounted on the portable devices. Such a connector has a structure into which memory cards of different thicknesses can be easily inserted (e.g., see Japanese Utility Model Registration No. 3079263).

The connector includes a flat base having a C shape in plane and substrates covering upper and lower surfaces of this base. Plural slots, which house memory cards, are formed in the base. These slots have different widths and heights according to widths and thicknesses of the memory cards. On the other hand, the substrates include contact parts in association with the respective memory cards.

Consequently, no matter which memory card is inserted into the connector, the contact parts of the substrates are electrically connected to the memory card. Therefore, plural kinds of memory cards with different shapes can be housed in one connector.

However, when a memorycard is inserted into the connector, the memory card comes into contact with not only corresponding contact parts but also the other contact parts.

For example, the connector has a structure in which an MMC, a Smart Media (registered trademark) card, and a memory stick card can be housed. When a memory stick card is inserted into the connector, an outer surface of this memory card comes into contact with contact parts for MMC.

Therefore, according to circumstances, the contact parts for MMC are worn simply by repeatedly inserting and pulling out the memory stick card, and durability of the contact parts for MMC cannot be secured sufficiently.

In particular, gilding is applied to contacts of the contact parts in order to connect the contact parts to a memory card surely. Thus, the gilding is worn by repeatedly inserting and pulling out the memory stick card.

SUMMARY OF THE INVENTION

In order to solve the above-mentioned problems, it is an object of the invention to provide a connector into which two kinds of memory cards with different thicknesses are insertable selectively and durability of which can be improved.

The inventor has invented a new connector as described below in order to attain the object.

(1) A connector into which two kinds of memory cards with different thicknesses are insertable selectively and which is electrically connected to the inserted memory card, the connector comprising: a housing of substantially a box shape having a card insertion port into which the memory card is inserted; plural elastically deformable first contacts which are provided inside the housing; plural elastically deformable second contacts which are provided between the first contacts and the card insertion port; wherein the second contacts extend toward the first contacts and include: first contact portions which is provided at distal ends of the second contacts and bent in an arc shape; and second contact portions which are provided further on proximal end sides of the second contacts than the first contacts and project in an arc shape in section; and wherein the second contact portions come into abutment against the thick memory card when the thick memory card is inserted into the card insertion port, and the first contact portions come into abutment against the thin memory card when the thin memory card is inserted into the card insertion port.

A memory card is a storage in which a memory chip is housed in a card type case and plural connection terminals are arranged at a leading end of the memory card. Examples of this memory card include an SD card and an MMC.

According to the invention described in (1), when a thicker one of the memory cards is inserted into the card insertion port, the second contact portions of the second contacts come into abutment against the thick memory card. On the other hand, when a thinner one of the memory cards is inserted into the card insertion port, the first contact portions come into abutment against the thin memory card.

Thus, since a portion coming into contact with a memory card is different depending upon a thickness of the memory card, durability of the contact can be improved.

(2) In the connector described in (1), wherein the housing includes: a flat base which extends along an inserting direction of the memory card; a pair of guide walls which are vertically provided on the base and guide both sides of the memory card; an abutment wall which is vertically provided on the base and against which the leading end of the memory card comes into abutment; and a cover which covers the base, and wherein the thicker one of the memory cards is an SD card and the thinner one of the memory cards is a multimedia card.

(3) In the connector described in (1) or (2), wherein the second contact portions of the second contacts have spherical surfaces.

(4) In the connector described in (1) or (2), wherein proximal end sides of the first contacts have first tabs which are exposed to the outside from the housing, and proximal end sides of the second contacts have second tabs which are exposed to the outside from the housing.

DETAILED DESCRIPTION OF THE PREFERRED EMBODIMENT

An embodiment of the invention will be hereinafter explained with reference to the accompanying drawings.

Figure 1A:
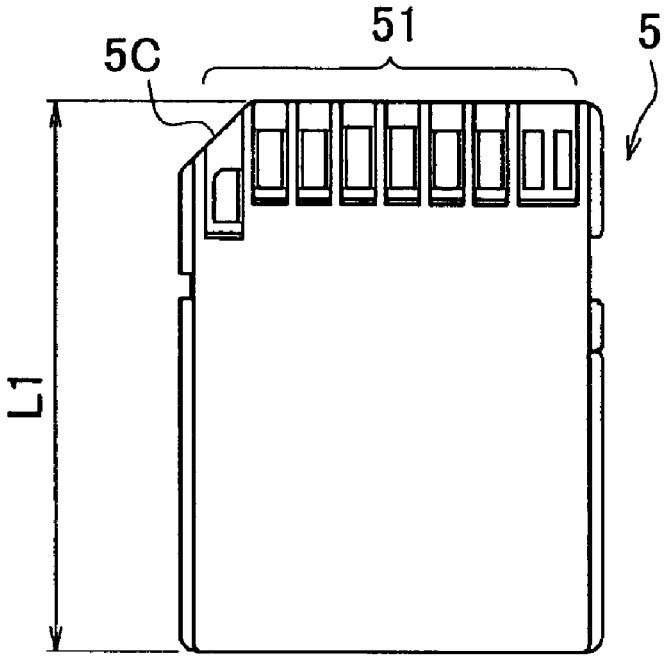
FIG. 1A is a plan view of an SD card which is a thicker one of memory cards to be inserted into a connector in accordance with an embodiment of the present invention.
Figure 1C:
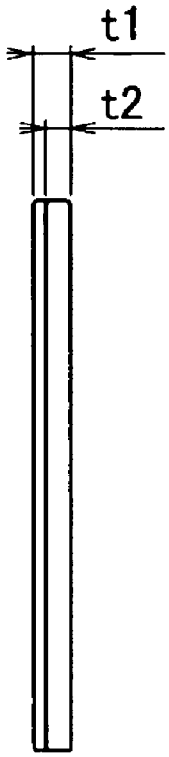
FIG. 1C is a side view of the SD card in accordance with the embodiment.
Figure 1B:
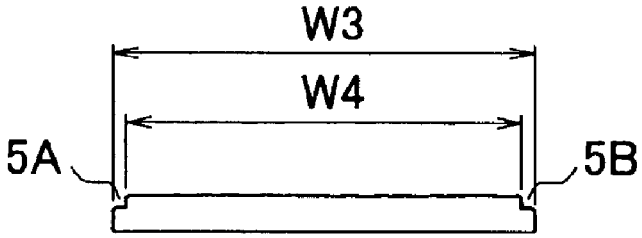
FIG. 1B is a front view of the SD card in accordance with the embodiment.

FIG. 1A is a plan view of an SD card 5 as a thicker one of memory cards to be inserted into a connector. FIG. 1B is a front view of the SD card 5. FIG. 1C is a side view of the SD card 5.

The SD card 5 is formed in a substantially rectangular flat shape and has connection terminals 51 with nine poles which are arranged along an edge on a distal end side thereof. This SD card 5 has a width W3 of 24 mm, a length L1 of 32 mm, and a thickness t1 of 2.1 mm.

Steps SA, SB with a thickness t2 of 1.4 mm are formed along both sides thereof. Note that, in order to prevent mishandling of the SD card 5, a cutout portion 5C is formed at one corner on the leading end side of the SD card 5.

Figure 2A:
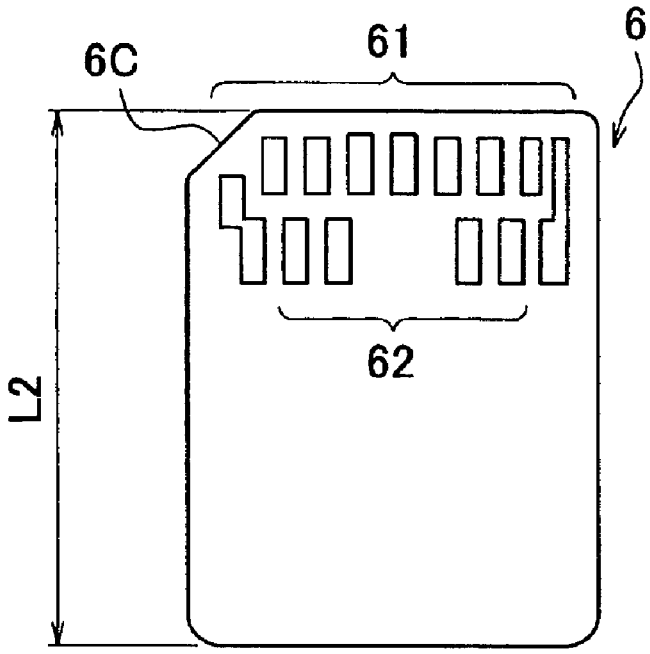
FIG. 2A is a plan view of an MMC which is a thinner one of the memory cards in accordance with the embodiment.
Figure 2C:
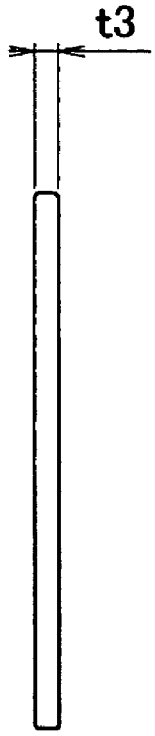
FIG. 2C is a side view of the MMC in accordance with the embodiment.
Figure 2B:
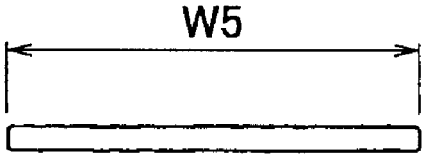
FIG. 2B is a front view of the MMC in accordance with the embodiment.

FIG. 2A is a plan view of an MMC 6 as a thinner one of the memory cards to be inserted in the connector. FIG. 2B is a front view of the MMC 6. FIG. 2C is a side view of the MMC 6.

The MMC 6 is formed in a substantially rectangular flat shape and has connection terminals 61 with nine poles which are arranged along an edge on a distal end side thereof and connection terminals 62 of four poles which are arranged on proximal end sides of the connection terminals 61. The connection terminals 61 of the MMC 6 are provided in the same positions as the connection terminals 51 of the SD card 5.

The MMC 6 has a width W5 of 24 mm and a length L2 of 32 mm which are the same as those of the SD card 5. In addition, a thickness t3 of the MMC 6 is 1.4 mm which is the same as the thickness t2 of the steps 5A, 5B of the SD card 5.

In order to prevent mishandling of the MMC 6, a cutout portion 6C is formed at one corner on the leading end side of the MMC 6. A shape of the cutout portion 6C is the same as the shape of the cutout portion 5C of the SD card 5.

Figure 3A:
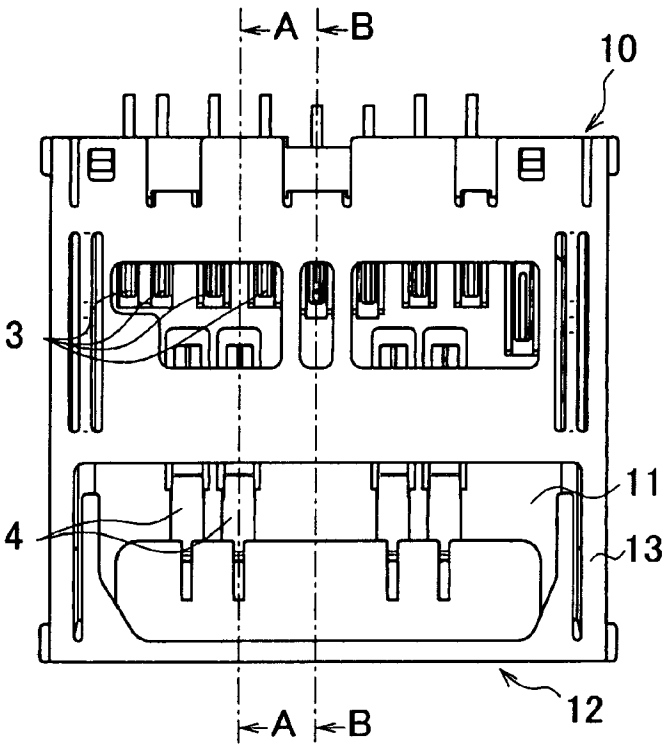
FIG. 3A is a plan view of the connector in accordance with the embodiment.
Figure 3B:
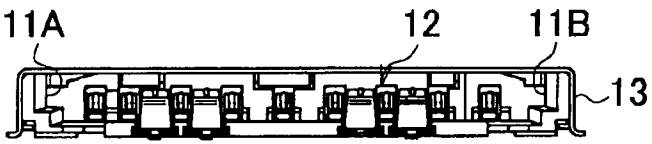
FIG. 3B is a front view of the connector in accordance with the embodiment.
Figure 3C:
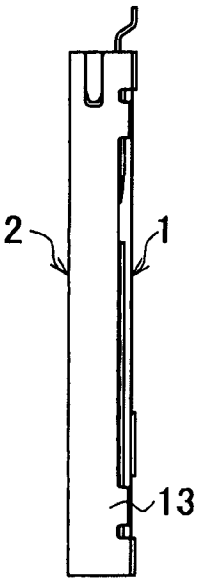
FIG. 3C is a side view of the connector in accordance with the embodiment.
Figure 3D:
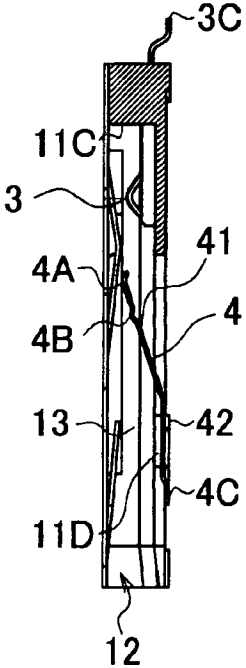
FIG. 3D is a sectional view along line A—A in FIG. 3A.
Figure 3E:
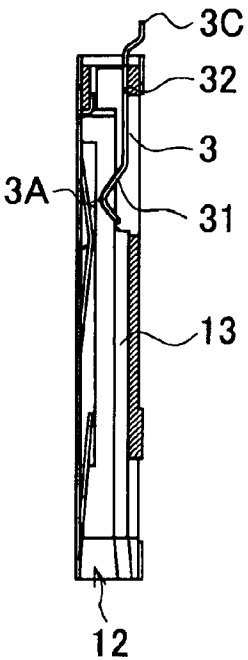
FIG. 3E is a sectional view along line B—B in FIG. 3A.

FIG. 3A is a plan view of a connector 10, FIG. 3B is a front view of the connector 10, and FIG. 3C is a side view of the connector 10. FIG. 3D is a sectional view along line A—A in FIG. 3A, and FIG. 3E is a sectional view along line B—B in FIG. 3A.

Two kinds of memory cards 5, 6 with different thicknesses are insertable into the connector 10 selectively, and the connector 10 is electrically connected to the inserted memory cards 5, 6.

The connector 10 includes a housing 13 of substantially a box shape in which a card insertion port 12, into which the memory cards 5, 6 are inserted, is formed, plural elastically deformable first contacts 3 which are provided in side the housing 13, and plural elastically deformable second contacts 4 which are provided between the first contacts 3 and the card insertion port 12.

Figure 4:
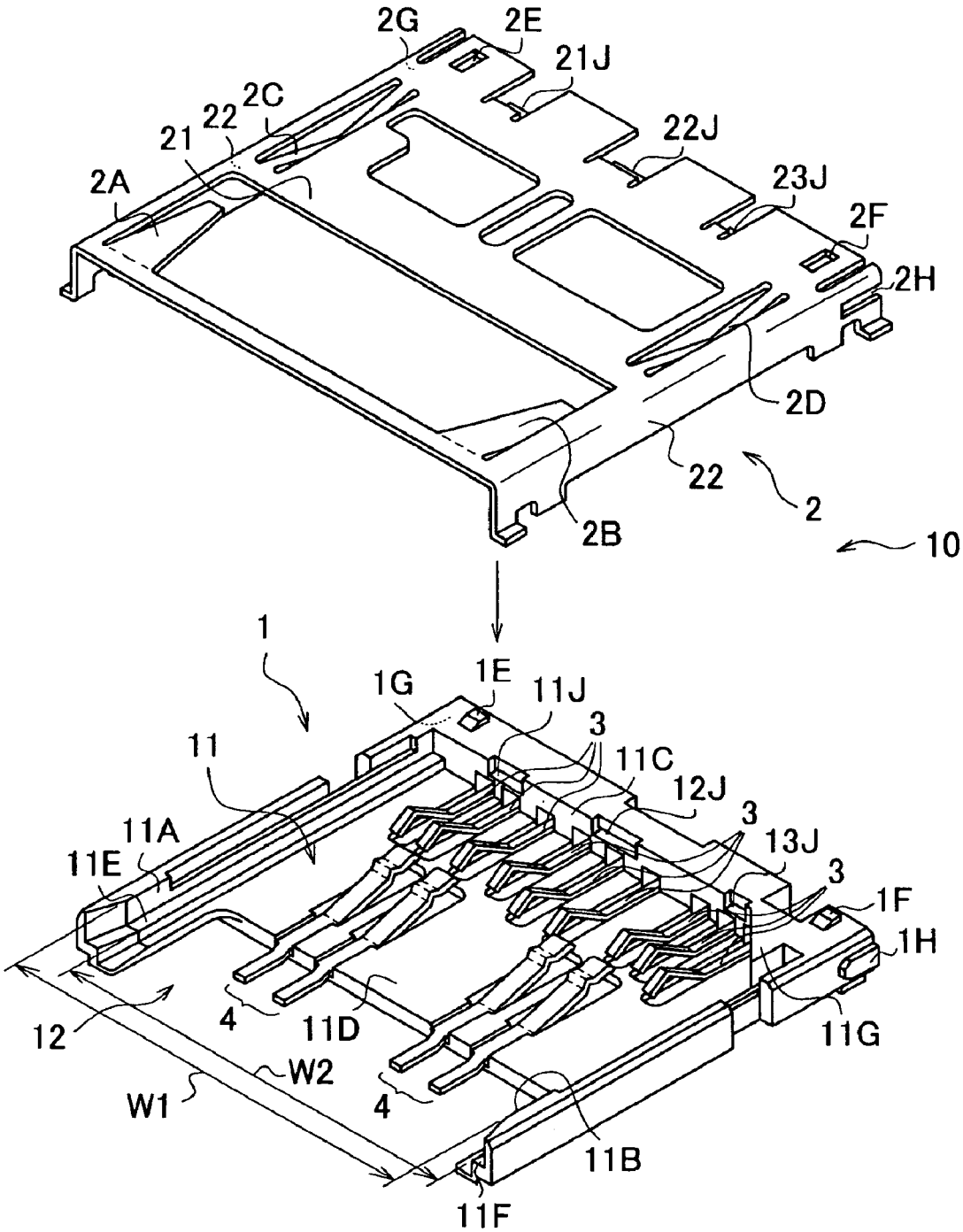
FIG. 4 is a disassembled perspective view of the connector in accordance with the embodiment.

FIG. 4 is a disassembled perspective view of the connector 10.

The housing 13 is insulative and includes a housing body 1 and a cover 2 which covers the housing body 1.

The housing body 1 includes a flat base 11D which extends along an inserting direction of a memory card, a pair of guide walls 11A, 11B which are vertically provided on the base 11D and guide both sides of the memory card, and an abutment wall 11C which is vertically provided on the base 11D and against which a leading end of the memory card comes into abutment. A space surrounded by the base 11D, the guide walls 11A, 11B, and the abutment wall 11C is a housing space 11.

A pair of projections 1E, 1F is formed on both sides of the abutment wall 11C. Recesses 11J, 12J, and 13J are formed on a card insertion port side of the abutment wall 11C.

A pair of projections 1G and 1H is formed on the abutment wall 11C side of the guide walls 11A, 11B. Grooves 11E, 11F are formed on the guide walls 11A, 11B in association with the steps 5A, 5B of the SD card 5.

A space W2 between the guide walls 11A, 11B is slightly wider than the width W3 of the SD card 5 and the width W5 of the MMC 6.

A space W1 between the grooves 11E, 11F of the guide walls 11A, 11B is slightly wider than the width W4 between the steps 5A, 5B of the SD card 5.

In order to prevent mishandling of the memory cards 5, 6, a projection 11G corresponding to the cutout portion 5C of the SD card 5 and the cutout portion 6C of the MMC 6 is formed at one corner of the housing space 11. Consequently, even if it is attempted to insert a memory card into the housing space 11 in a state in which connection terminals of the memory card faces upward, since the projection 11G interferes with a leading end of the memory card, the memory card cannot be inserted into the housing space 11 completely.

The cover 2 includes a flat cover body 21 which is formed by bending a metal plate in a C shape in section and side walls 22 which extend downward from both sides of the cover body 21. A pair of first elastic pieces 2A, 2B, which extend toward the housing body 1, is formed on a card insertion port side of the cover body 21. In addition, a pair of second elastic pieces 2C and 2D, which extend toward the housing body 1, is formed in a central part of the cover body 21.

A pair of openings 2E, 2F, which fit with the projections 1E, 1F of the housing body 1, and bent pieces 21J, 22J, and 23J, which are provided between the openings 2E, 2F and engage with the recesses 11J, 12J, and 13J of the housing body 1, are formed on a side opposite to the card insertion port 12 of the cover body 21. Cutouts 2G and 2H, which fit with the pair of projections 1G and 1H of the housing body 1, are formed on a side opposite to the card insertion port 12 of the side walls 22.

The first contacts 3 are provided on the abutment wall 11C side of the base 11D. The first contacts 3 include fixed portions 32, which are fixed to the base 11D, and elastically deformable contact bodies 31, which extend toward the card insertion port 12 from the fixed portions 32. First tabs 3C, which are exposed to the outside from the housing 13, are formed on proximal end sides of the fixed portions 32 of the first contacts 3.

The second contacts 4 are provided on the card insertion port 12 side of the base 11D. The second contacts 4 include fixed portions 42, which are fixed to the base 11D, and contact bodies 41, which extend toward the first contacts 3. Second tabs 4C, which are exposed to the outside from the housing 13, are formed on proximal end sides of the fixed portions 42 of the second contacts 4.

First contact portions 4A bent in an arc shape are provided at distal ends of the contact bodies 41, and second contact portions 4B projecting in an arc shape are provided further on the proximal end sides than the first contact portions 4A of the contact bodies 41.

Gilding is applied to surfaces of the first contact portions 4A.

Next, an operation for inserting the memory cards 5, 6 into the connector 10 described above will be explained with reference to FIGS. 5 to 7.

Figure 5:
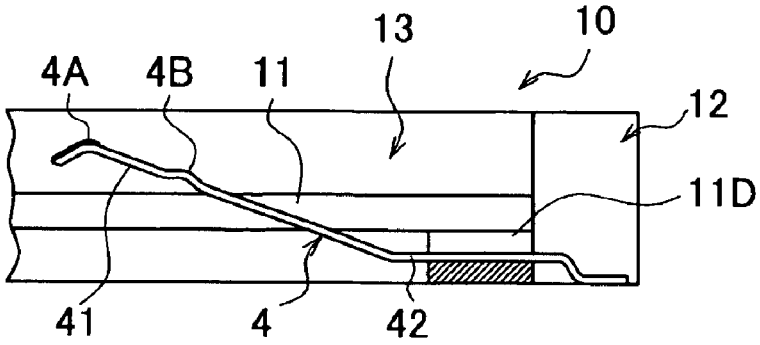
FIG. 5 is a sectional view showing a state in which a memory card is not inserted into the connector in accordance with the embodiment.

When the SD card 5, which is the thicker one of the memory cards 5, 6, is inserted into the card insertion port 12 of the connector 10 under the state shown in FIG. 5, the sides of the SD card 5 are guided by the guide walls 11A, 11B, and the connection terminals 51 of the SD card 5 are positioned in a width direction of the SD card 5. At the same time, a distal end side lower surface of the SD card 5 comes into abutment against a part further on the proximal end side than the second contact portion 4B of the second contact 4.

Figure 6:
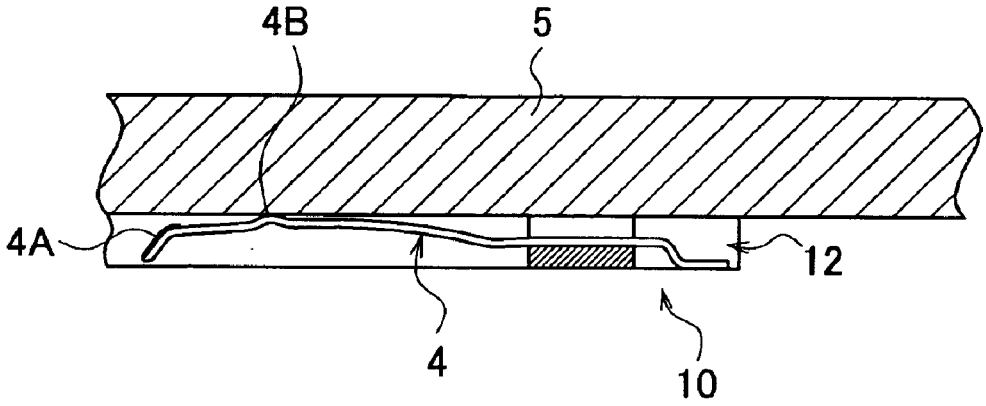
FIG. 6 is a sectional view showing a state in which an SD card is inserted into the connector in accordance with the embodiment.
Figure 7:
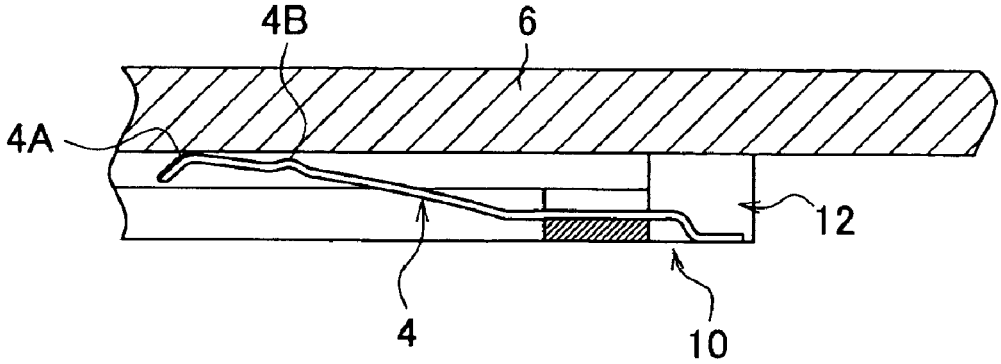
FIG. 7 is a sectional view showing a state in which an MMC is inserted into the connector in accordance with the embodiment.

When the SD card 5 is inserted more deeply, this SD card 5 moves on the surface of the second contact 4 toward the second contact portion 4B while pressing and elastically deforming the second contact 4 and comes into abutment against the second contact portion 4B as shown in FIG. 6. Therefore, the first contact portion 4A of the second contact 4 moves to be lower than the second contact portion 4B without coming into contact with the SD card 5. Thus, the first contact portion 4A can be prevented from coming into contact with the SD card 5.

On the other hand, when the MMC 6, which is the thinner one of the memory cards, is inserted into the card insertion port 12 of the contact 10, the sides of the MMC 6 are guided by the guide walls 11A, 11B, and the connection terminals 61 of the MMC 6 are positioned in a width direction of the MMC 6. At the same time, a distal end side lower surface of the MMC 6 comes into abutment against a part further on the leading end side than the second contact portion 4B of the second contact 4.

When the MMC 6 is inserted more deeply, this MMC 6 moves on the surface of the second contact 4 toward the first contact portion 4A while pressing and elastically deforming the second contact 4 and comes into abutment against the first contact portion 4A. Therefore, the second contact portion 4B of the second contact 4 is always located below the first contact portion 4A. Thus, the second contact portion 4B can be prevented from coming into contact with the MMC 6.

According to this embodiment, there are advantages as described below.

In the case in which the SD card 5 is inserted into the connector 10, only the second contact portions 4B can be brought into contact with the SD card 5, and in the case in which the MMC 6 is inserted into the connector 10, only the first contact portions 4A can be brought into contact with the MMC 6.

Thus, since the first contact portions 4A or the second contact portions 4B of the second contacts 4 come into contact with a memory card depending upon a thickness of the memory card, the second contacts 4 can be used over a long period of time.

Note that the invention is not limited to the above-mentioned embodiment, and modifications, improvements, and the like in a range in which the object of the invention can be attained are included in the invention.

For example, although the second contact portions 4B of the second contacts 4 are assumed to be formed in an arc shape in the embodiment, a shape of the second contact portions 4B is not limited to this but may be semispherical.

According to the connector of the invention, there are advantages as described below.

When a thicker one of memory cards is inserted into the card insertion port, the second contact portions of the second contacts come into abutment against this thick memory card. On the other hand, when a thinner one of the memory cards is inserted into the card insertion port, the first contact portions come into abutment against this thin memory card. Thus, since a portion coming into contact with a memory card is different depending upon a thickness of the memory card, durability of the connector can be improved.

What is claimed is:

1. A connector into which two kinds of memory cards with different thicknesses are insertable selectively and which is electrically connected to the inserted memory card, the connector comprising:

a housing of substantially a box shape having a card insertion port into which the memory card is inserted;

plural elastically deformable first contacts which are provided inside the housing;

plural elastically deformable second contacts which are provided between the first contacts and the card insertion port;

wherein the second contacts extend toward the first contacts and include: first contact portions which is provided at distal ends of the second contacts and bent in an arc shape; and second contact portions which are provided further on proximal end sides of the second contacts than the first contacts and project in an arc shape in section; and wherein the second contact portions only electrically contact against a contact of the thicker memory card when the thicker memory card is inserted into the card insertion port, and the first contact portions only electrically contact against a contact of the thinner memory card when the thinner memory card is inserted into the card insertion port.

2. The connector according to claim 1, wherein the housing includes:

a flat base which extends along an inserting direction of the memory card;

a pair of guide walls which are vertically provided on the base and guide both sides of the memory card;

an abutment wall which is vertically provided on the base and against which the leading end of the memory card comes into abutment; and a cover which covers the base, and wherein the thicker one of the memory cards is an SD card and the thinner one of the memory cards is a multimedia card.

3. The connector according to claim 1 or 2, wherein the second contact portions of the second contacts have spherical surfaces.

4. The connector according to claim 1 or 2, wherein proximal end sides of the first contacts have first tabs which are exposed to the outside from the housing, and proximal end sides of the second contacts have second tabs which are exposed to the outside from the housing.

* * * * *